US007581654B2

(12) United States Patent
Stowitts

(10) Patent No.: US 7,581,654 B2
(45) Date of Patent: Sep. 1, 2009

(54) ROUND HOUR-GLASS HOT-FILLABLE BOTTLE

(75) Inventor: Adam P. S. Stowitts, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 583 days.

(21) Appl. No.: 11/504,268

(22) Filed: Aug. 15, 2006

(65) Prior Publication Data

US 2008/0041811 A1 Feb. 21, 2008

(51) Int. Cl.
*B65D 90/02* (2006.01)

(52) U.S. Cl. ..... 215/383; 215/381; 215/382; 215/384; 220/675; 220/DIG. 12; D9/539

(58) Field of Classification Search ..... 215/381–384; 220/675, DIG. 12; D9/538–543
See application file for complete search history.

(56) References Cited

U.S. PATENT DOCUMENTS

| | | | | |
|---|---|---|---|---|
| D69,992 | S | | 4/1926 | Grannan |
| D70,614 | S | | 7/1926 | Jones |
| D70,765 | S | | 8/1926 | Jones |
| D71,777 | S | | 1/1927 | Comati et al. |
| D86,680 | S | | 4/1932 | Mas |
| D94,157 | S | | 12/1934 | Marcus |
| D98,504 | S | * | 2/1936 | Ennever ..... D9/541 |
| D110,034 | S | | 6/1938 | Reynolds |
| D120,271 | S | | 4/1940 | Meier |
| 3,325,031 | A | | 6/1967 | Singier |
| D230,931 | S | | 3/1974 | Sewell |
| 4,497,855 | A | | 2/1985 | Agrawal et al. |
| 4,790,361 | A | | 12/1988 | Jones et al. |
| 4,863,046 | A | | 9/1989 | Collette et al. |
| 4,877,141 | A | * | 10/1989 | Hayashi et al. ..... 215/381 |
| 4,890,752 | A | | 1/1990 | Ota et al. |
| 4,946,053 | A | | 8/1990 | Conrad |
| D315,678 | S | | 3/1991 | Darr |
| 5,067,622 | A | | 11/1991 | Garver et al. |
| D322,562 | S | | 12/1991 | Narsutis |
| D331,880 | S | | 12/1992 | Wegner, IV et al. |
| D331,881 | S | | 12/1992 | Garver et al. |
| 5,178,289 | A | * | 1/1993 | Krishnakumar et al. ..... 215/382 |
| 5,199,588 | A | | 4/1993 | Hayashi |
| D337,522 | S | | 7/1993 | Kingsbury |
| 5,261,543 | A | | 11/1993 | Ugarelli |
| D346,556 | S | | 5/1994 | Sirico et al. |

(Continued)

FOREIGN PATENT DOCUMENTS

| | | |
|---|---|---|
| WO | WO 00/50309 | 8/2000 |

*Primary Examiner*—Anthony D Stashick
*Assistant Examiner*—Ned A Walker
(74) *Attorney, Agent, or Firm*—Brinks Hofer Gilson & Lione

(57) ABSTRACT

A blow-molded container has a body portion extending upward from a base. A shoulder portion extends upward and axially inward above an upper margin of the side wall to a finish defining an opening adapted to accept a closure. Horizontal linear segments are joined end to end to define a waist of polygonal cross-section. Each linear segment joins a pair of vertically diverging surfaces, the surfaces having lateral edges. A protruding panel is situated between the lateral edges of each horizontally adjacent pair of diverging surfaces. The panel includes a dimple that can act as a deflection initiation point, with any vacuum induced deflection progressively expanding laterally and axially in response to increasing vacuum within the container.

5 Claims, 5 Drawing Sheets

U.S. PATENT DOCUMENTS 5,341,946 A * 8/1994 Vailliencourt et al. ..... 215/381
5,381,910 A 1/1995 Sugiura et al.
D366,831 S * 2/1996 Semersky et al. ..... D9/434
D367,426 S 2/1996 Ruff
D367,613 S 3/1996 Weiler
D369,558 S 5/1996 Heinz
D380,671 S 7/1997 Young
D384,586 S 10/1997 Peek
5,732,838 A 3/1998 Young
5,762,221 A 6/1998 Tobias et al.
D405,698 S * 2/1999 Lykken et al. ..... D9/541
D411,460 S 6/1999 Nobuto
5,971,184 A 10/1999 Krishnakumar et al.
6,044,996 A 4/2000 Carew et al.
6,062,409 A * 5/2000 Eberle ..... 215/381
D433,946 S * 11/2000 Rollend et al. ..... D9/538
6,213,326 B1 4/2001 Denner et al.
D441,659 S * 5/2001 Di Canio et al. ..... D9/550
D449,000 S 10/2001 Brown, III
D453,112 S 1/2002 Macky et al.
D459,995 S 7/2002 Hong et al.
D466,022 S * 11/2002 Hirst et al. ..... D9/539
D467,507 S 12/2002 Bryant et al.
D470,058 S 2/2003 Bryant et al.
6,513,669 B2 * 2/2003 Ozawa et al. ..... 215/381
6,550,627 B2 4/2003 Elich et al.
6,575,321 B2 6/2003 Bourque et al.
D478,278 S 8/2003 Masotta et al.
6,637,613 B2 10/2003 Shimada et al.
D482,976 S * 12/2003 Melrose ..... D9/537
6,662,960 B2 12/2003 Hong et al.
D492,201 S * 6/2004 Pritchett et al. ..... D9/537
6,749,075 B2 6/2004 Bourque et al.
6,779,673 B2 8/2004 Melrose et al.
6,837,390 B2 * 1/2005 Lane et al. ..... 215/381
6,841,262 B1 1/2005 Beck et al.
D504,617 S 5/2005 Pedmo et al.
6,923,334 B2 8/2005 Melrose et al.
6,938,788 B2 9/2005 White
6,983,858 B2 * 1/2006 Slat et al. ..... 215/373
D515,430 S * 2/2006 Venkataraman et al. ..... D9/538
7,014,056 B2 * 3/2006 Trude ..... 215/381
D535,884 S * 1/2007 Davis et al. ..... D9/538
7,172,087 B1 * 2/2007 Axe et al. ..... 215/382
7,178,684 B1 * 2/2007 Budden et al. ..... 215/381
7,178,687 B1 * 2/2007 Manderfield et al. ..... 220/675
D538,168 S * 3/2007 Davis et al. ..... D9/538
7,191,910 B2 * 3/2007 Deemer et al. ..... 215/381
D543,116 S * 5/2007 Heisner ..... D9/540
D547,664 S * 7/2007 Davis et al. ..... D9/538
D559,112 S * 1/2008 Hyde et al. ..... D9/538
D565,416 S * 4/2008 Lepoitevin ..... D9/538
D572,599 S * 7/2008 Melrose ..... D9/652
D583,245 S * 12/2008 Lepoitevin ..... D9/538
7,472,798 B2 * 1/2009 Stowitts ..... 215/381
2001/0054597 A1 * 12/2001 Ozawa et al. ..... 215/381
2002/0008077 A1 * 1/2002 Lane et al. ..... 215/381
2002/0104820 A1 8/2002 Hong et al.
2003/0015491 A1 1/2003 Melrose et al.
2003/0173327 A1 9/2003 Melrose
2003/0205550 A1 11/2003 Prevot et al.
2004/0016716 A1 1/2004 Melrose et al.
2004/0074864 A1 4/2004 Melrose et al.
2004/0129669 A1 7/2004 Kelley et al.
2004/0164047 A1 * 8/2004 White ..... 215/384
2005/0121408 A1 * 6/2005 Deemer et al. ..... 215/381
2005/0269284 A1 * 12/2005 Pedmo et al. ..... 215/381
2007/0075032 A1 * 4/2007 Kelley et al. ..... 215/384
2007/0090083 A1 * 4/2007 Trude ..... 215/384
2008/0041812 A1 * 2/2008 Stowitts ..... 215/384
2008/0257856 A1 * 10/2008 Melrose et al. ..... 215/381

* cited by examiner

ROUND HOUR-GLASS HOT-FILLABLE BOTTLE

BACKGROUND OF THE INVENTION

The present invention relates to blow-molded plastic bottles useful in containing hot-filled beverages. The present invention relates particularly to single serve hot-fill containers that are readily grippable by one hand placed about the container sidewall.

Plastic blow molded containers have previously been provided with an inwardly extending grip that facilitates handling of the container during dispensing of its contents. The inwardly extending construction of the grip also provides a more rigid construction after the container is opened so that the gripping of the container can be maintained with less flexing. For example, Young, U.S. Pat. No. 5,732,838, discloses a plastic container having an inwardly extending lower annular grip section having depressions spaced about a central axis of the container. Each depression has a lower blunt end, an upper generally pointed end, and an intermediate portion having sides that taper toward each other in an upward direction. The lower location of the annular grip section facilitates manual grasping of the bottle when initially grasped from a horizontal support surface while the tapering configuration of the depressions facilitates manual fingertip gripping of the container by varying hand sizes. Young does not disclose any structure designed to accommodate the vacuum that typically develops in a container subsequent to capping the container that has been filled with a hot liquid.

U.S. Pat. Nos. 4,497,855; 5,971,184; and 6,044,996 are representative of patents disclosing containers specifically designed for hot fill applications. The containers typically have a plurality of panels spaced around the sidewall of the container that are designed to flex inward in response to the vacuum that typically develops in a container subsequent to a hot filling and capping operation. The vacuum responsive panels are separated by vertical supporting structures such as posts or lands that generally define the maximum sidewall radius measured from the axis of the container. The vacuum responsive panels are generally initially positioned at a non-protruding position as compared with the vertical posts or lands. The vacuum responsive panels move inwardly in response to, and to compensate for, an increasing vacuum within the container. While the inward movement is intended to be the same for all panels around the perimeter of the container, even small differences in wall thickness or geometry can cause one or more of the posts or lands of the container to buckle. Special geometries for the posts or lands have been adopted to inhibit such buckling as shown, for example, in U.S. Pat. No. 4,863,046. Still, the buckling problem persists.

Despite the various features and benefits of the structures of the forgoing disclosures, there remains a need for a container that can be hot filled and have a geometry that is readily grippable by one hand placed about the container sidewall. There further remains a need for such a container having a sidewall that effectively resists that buckling tendency of the vertical supporting elements.

SUMMARY OF THE INVENTION

These several needs are satisfied by a blow-molded container having a base, a body portion extending upward from the base including an upper margin, a shoulder portion extending upward and axially inward above the upper margin of the side wall to a finish defining a opening adapted to accept a closure. The body portion has a plurality of horizontal linear segments defining a waist of the container. The plurality of horizontal linear segments defining the waist can be joined end to end so as to substantially form, in horizontal cross-section, a polygon. Each linear segment joins a pair of vertically diverging surfaces, the surfaces having lateral edges. A panel is situated between the lateral edges of each horizontally adjacent pair of diverging surfaces that can be vacuum responsive.

The panels are initially generally convex, particularly adjacent the lateral edges of the adjacent diverging surfaces, and can protrude outward from the adjacent diverging surfaces. Each panel preferably has a concave dimple that can be positioned on the lateral midline of the panel that can act as a deflection initiation point when the container is hot filled, capped and cooled. The panels can extend from a point on the waist of the container toward the upper and lower margins of the body portion, the panels becoming laterally wider with increasing distance from the waist of the container.

The vertically diverging surfaces can be planar, with the width of the surfaces diminishing from the waist to mere points generally symmetrically spaced above and below the waist. The vertically diverging surfaces intersect at the waist at a vertical angle that can vary from 120° to 160°. By way of example, in a container intended to contain 600 ml., the vertically diverging surfaces can define a waist that is substantially square in horizontal cross-section and intersect at a vertical angle of about 142°.

One feature of the present invention is the use of panels that can respond to a vacuum within the container to define the majority of the surface area of the body portion of the container. The panels are separated from each other by comparatively smaller structural elements formed by the vertically diverging surfaces that resist the compressive forces presented by any cooling liquid within the container.

Other features of the present invention and the corresponding advantages of those features will be come apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
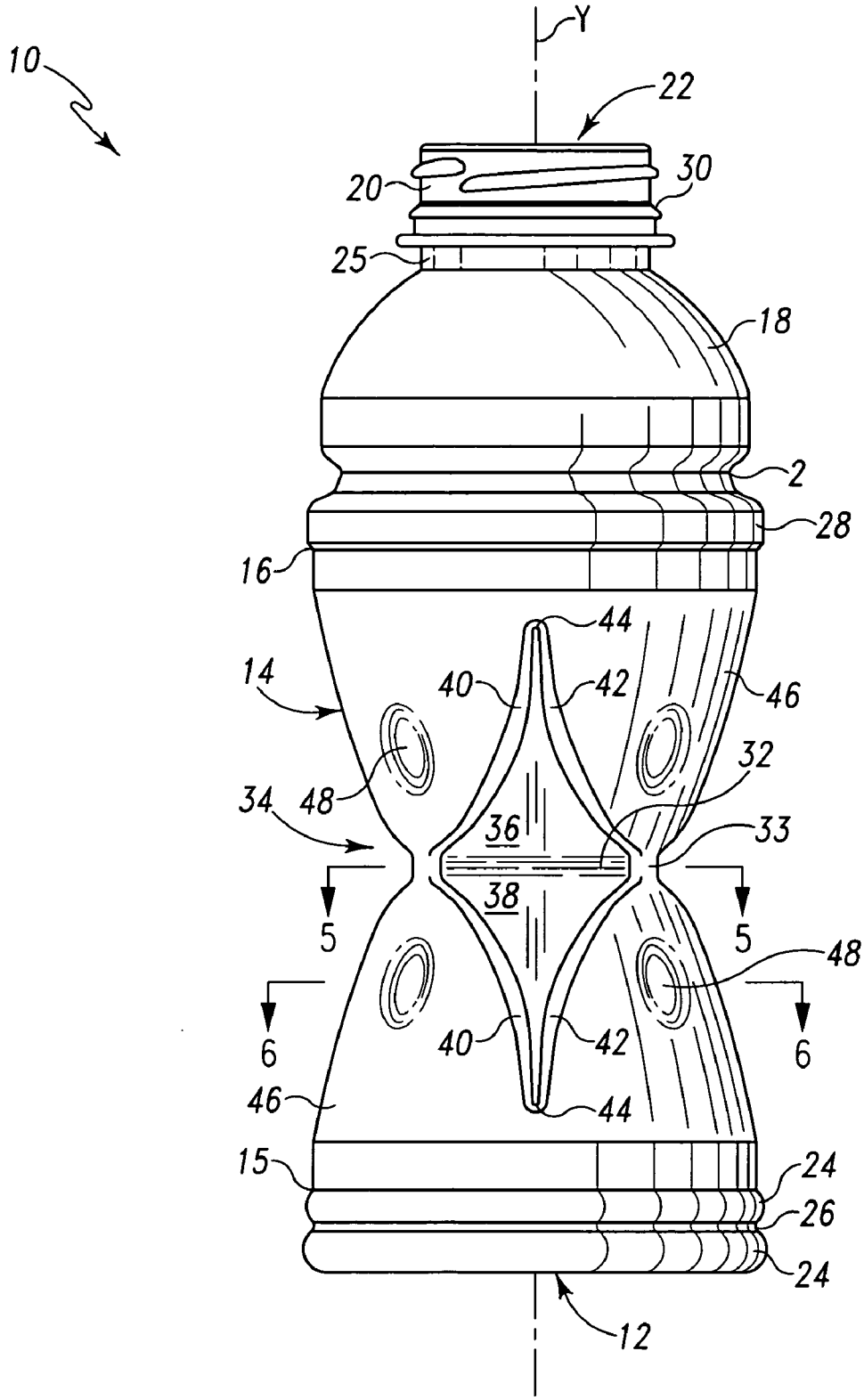
FIG. 1 is a side elevation view of a container embodying the present invention.

A blow-molded container 10 is shown in FIG. 1 generally to have a base 12. A body portion 14 extends upward from the base 12 from a lower margin 15 to an upper margin 16. A shoulder portion 18 extends upward and radially inward above the upper margin 16 to a finish 20 defining an opening 22 leading to the interior of the container 10, the finish 20 being adapted to accept a closure, not shown. One or more radial protrusions 24 and/or indentations 26 can surround the base 12 and/or lower margin 15. The shoulder portion 18 can also include one or more indented or protruding rings 28 generally adjacent the upper margin 16. The shoulder portion 18 can be coupled to the upper margin 16 by an inwardly extending hoop ring 23. The upwardly domed portion 18 can join a neck 25 leading to the finish 20 that surrounds the opening 22 leading to the interior of the container 10. The finish 20 can include bands and/or rings 30 to cooperate with tamper evident features of the closure.

Figure 2:
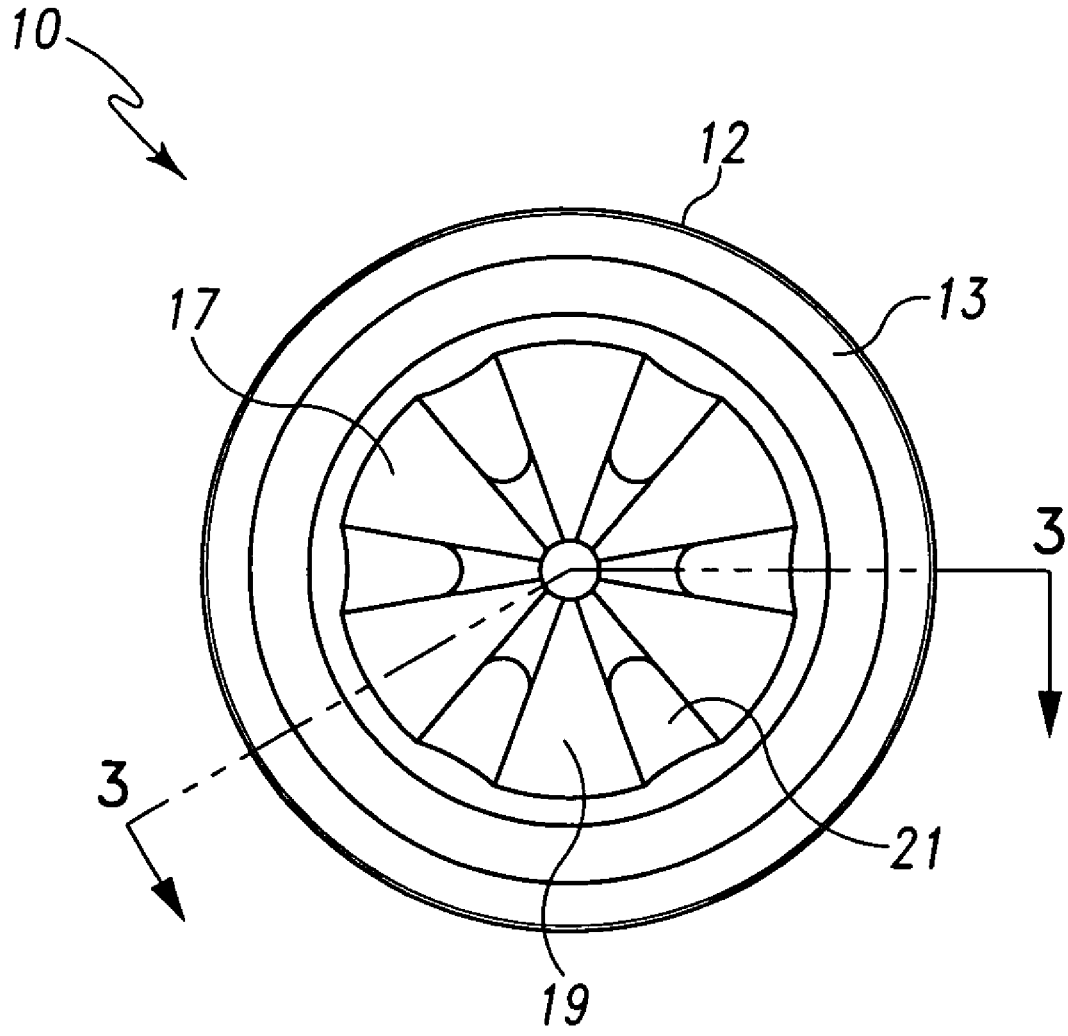
FIG. 2 is a bottom plan view of the container shown in FIG. 1.
Figure 3:
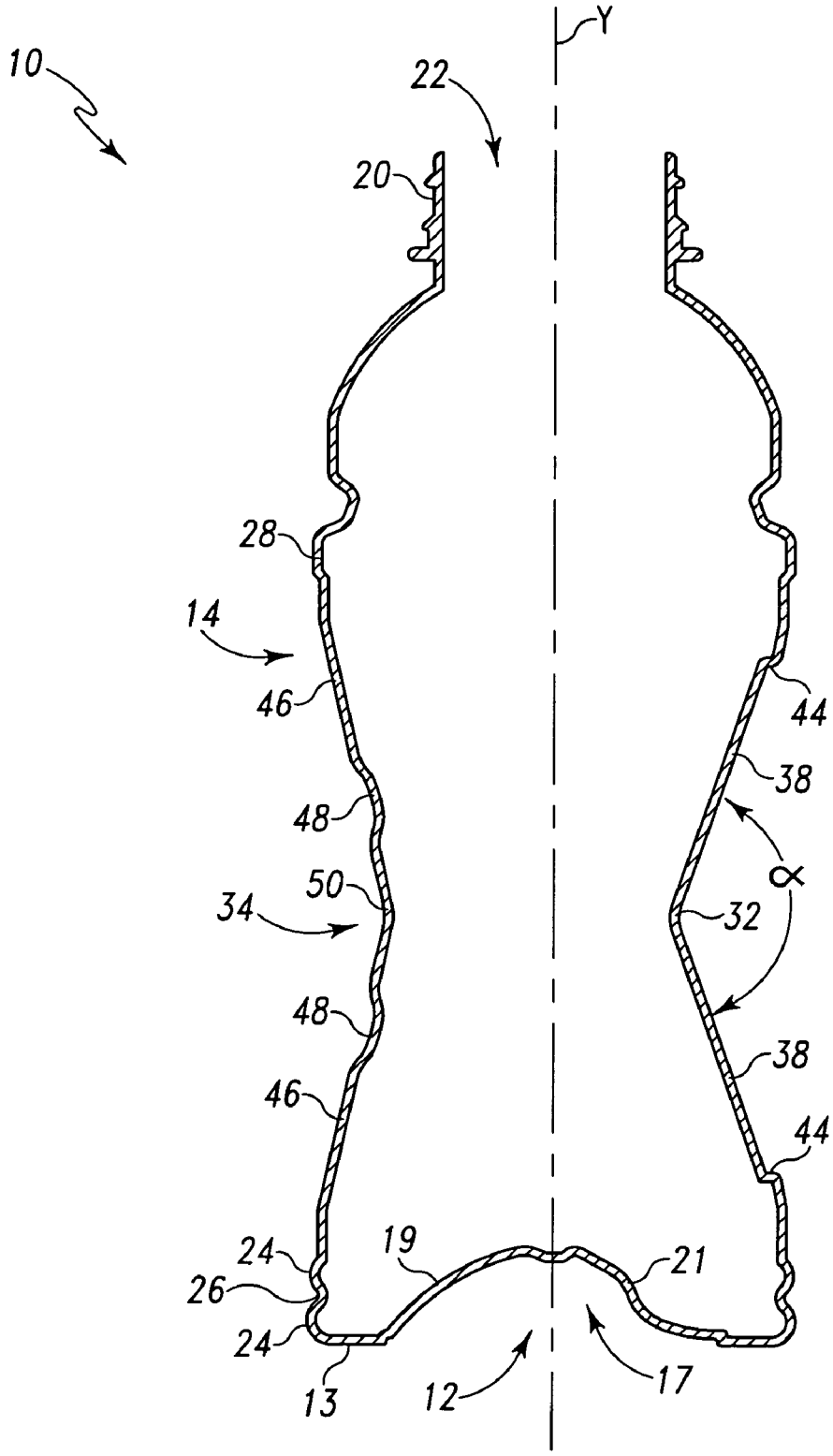
FIG. 3 is a vertical sectional view of the container shown in FIG. 2 taken along line 3-3.
Figure 4:
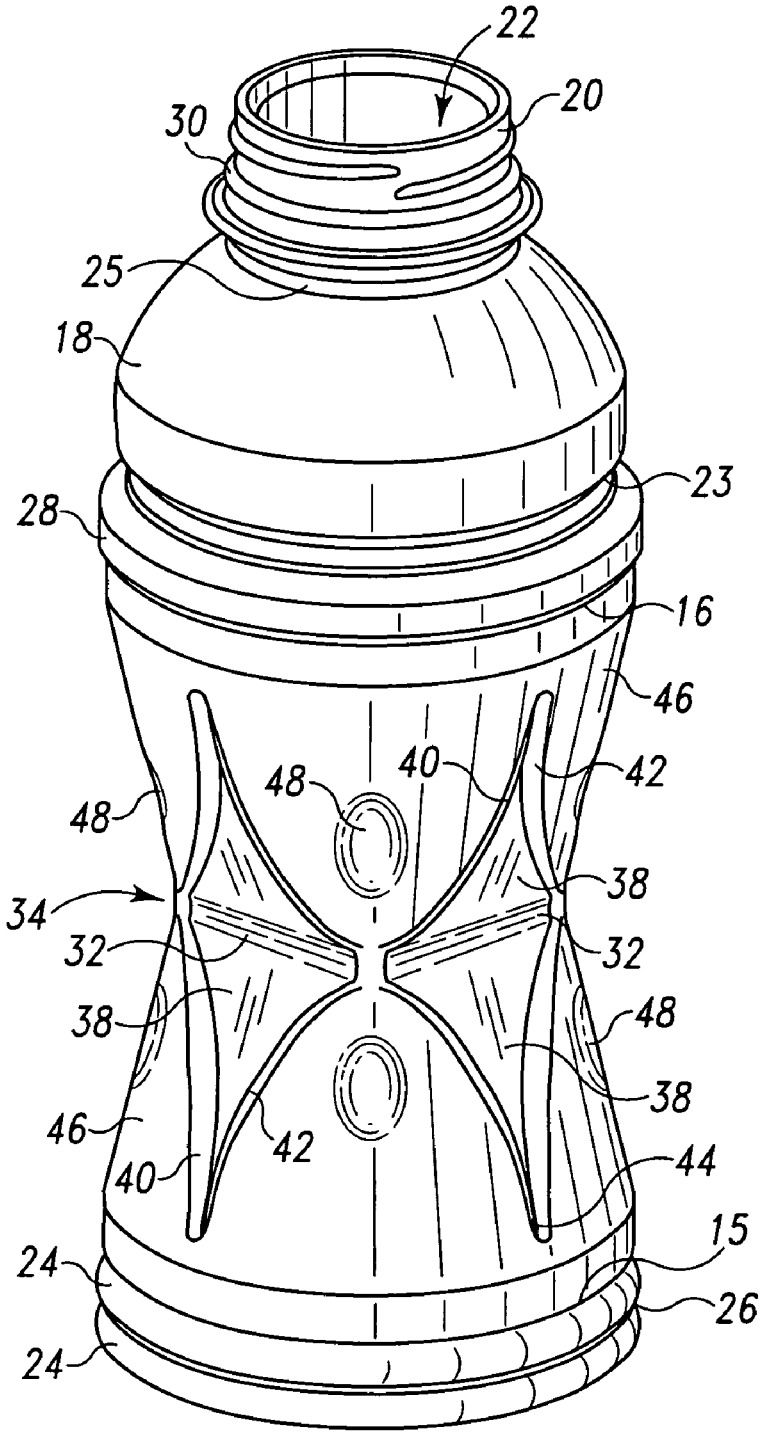
FIG. 4 is a perspective view from the upper right of FIG. 1.

The base 12 is shown in FIG. 2 to be circular and can have a generally planar support ring 13 on which the container 10 stands on any underlying support surface. The base 12 can also include a central portion 17 that is upwardly off-set above the support ring 13 as shown FIG. 3. The central portion 17 of the base 12 can include a plurality upwardly domed segments 19 and angular ribs 21 that are interspersed with each other. Other base designs can also be used with the present container 10, which may include pressure or vacuum compensation areas.

Figure 5:
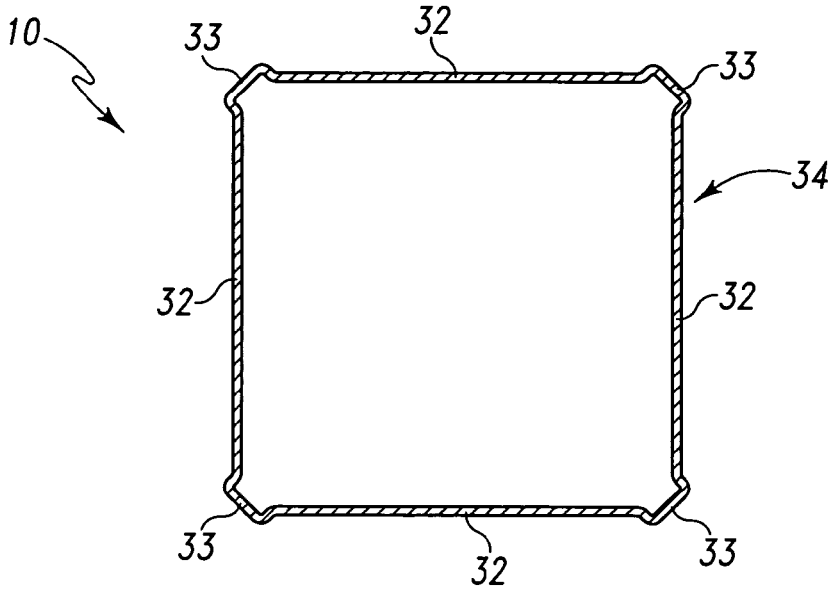
FIG. 5 is a horizontal sectional view taken along line 5-5 from FIG. 1.

The body portion 14 has a plurality of horizontal linear segments 32 that define the waist 34 of the container 10. The plurality of horizontal linear segments 32 defining the waist 34 can be joined end to end by corner elements 33 so as to substantially form, in horizontal cross-section, a polygon as seen in FIG. 5. While FIG. 5 illustrates a container 10 having a generally square waist 34, it will be appreciated that the waist 34 could take the form of other polygons such as a triangle, pentagon, hexagon, etc. Each linear segment 32 joins a pair of vertically diverging surfaces 36, 38. Each of the diverging surfaces 36 and 38 has lateral edges 40, 42. The vertically diverging surfaces 36, 38 can be planar. The lateral edges 40, 42 are such that the width of the surfaces 36, 38 diminishes from the waist 34 to mere points 44 generally symmetrically spaced above and below the waist 34, and preferably in the immediate vicinity of indented or protruding rings 28. The vertically diverging surfaces 36, 38 intersect at the waist 34 at a vertical angle $\alpha$, shown best in FIG. 3, which can vary from 120° to 160°. By way of example, in a container 10 intended to contain 600 ml., the vertically diverging surfaces 36, 38 intersect at a vertical angle of about 142° to define a waist 34 that is substantially square in horizontal cross-section.

Figure 6:
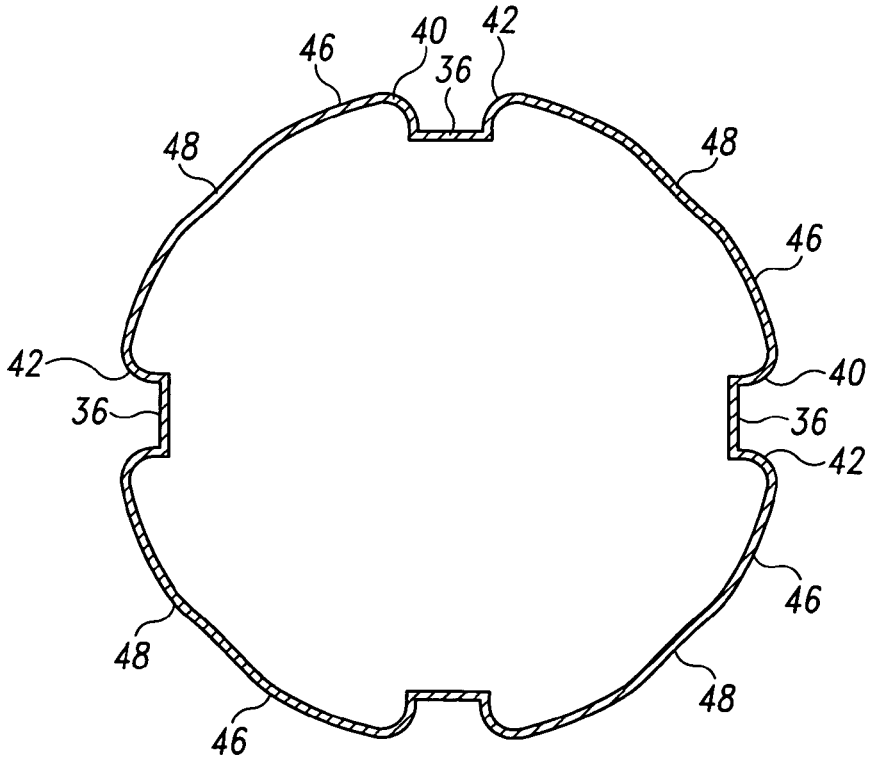
FIG. 6 is a horizontal sectional view taken along line 6-6 from FIG. 1.

A panel 46 is situated between the lateral edges 40, 42 of each horizontally adjacent pair of diverging surfaces 36 and/or 38. The panels 46 are shown to be generally convex, particularly adjacent the lateral edges 40, 42 of the adjacent diverging surfaces as shown in FIG. 6. The panels 46 can protrude outward from the adjacent diverging surfaces 36 and/or 38. Each panel 46 can have a concave dimple 48 that can be positioned on the lateral midline of the panel 46 as shown in FIG. 6. The panels 46 can extend from a point 50 on the waist 34 of the container 10 toward the upper and lower margins 16, 15 of the body portion 14. The panels 46 can generally become laterally wider with increasing distance from the waist 34 of the container 10.

In operation, when the container is hot filled, capped and cooled, the concave dimple 48 in each panel 46 can act as a deflection initiation point, with any vacuum induced deflection progressively expanding laterally and axially in response to increasing vacuum within the container 10, thereby providing a controlled, measured response to the thermally induced vacuum. The controlled, measured response of the panels 46 to the increasing vacuum effectively resists any buckling tendency of the vertical supporting elements provided by diverging surfaces 36 and 38. At the same time, the linear segments 32 defining the waist 34 resist any significant radial movement, both under the influence of the thermally induced vacuum and any gripping pressure applied by a consumer.

While these features have been disclosed in connection with the illustrated preferred embodiment, other embodiments of the invention will be apparent to those skilled in the art that come within the spirit of the invention as defined in the following claims.

What is claimed is:

1. A blow-molded container comprising a base, a body portion extending upward from the base, the body portion including an upper margin and a lower margin, a shoulder portion extending upward and axially inward from the upper margin of the body portion to a finish defining a opening adapted to accept a closure, the body portion comprising a plurality of pairs of vertically situated mirror-symmetric panels, each pair of panels including an upper panel having a linear upper edge and a lower panel having a linear lower edge, the linear upper and lower edges of the panels defining a continuous horizontal ring at the upper and lower margins of the body portion, a plurality of horizontal linear segments defining a waist of the body portion, a pair of diverging surfaces extending vertically away from each horizontal linear segment, each of the diverging surfaces laterally separating laterally adjacent vacuum responsive panels, the lateral edges of each panel protruding outward from the diverging surfaces to form a generally convex portion adjacent said lateral edges surrounding a concave dimple located on an axial midline of each of the panels.

2. The blow-molded container of claim 1 wherein each panel above the waist of the body portion extends upward to the upper margin which is circular in horizontal cross-section, each panel below the waist of the body portion extends downward to a lower margin contiguous to the base which is circular in horizontal cross-section, and wherein the waist is substantially polygonal in horizontal cross-section.

3. The blow-molded container of claim 1 wherein the vertically diverging surfaces are planar, and the lateral edges of the vertically diverging surfaces taper from the waist to points symmetrically spaced above and below the waist.

4. The blow-molded container of claim 1 wherein the area covered by the concave dimple progressively expands in response to increasing vacuum within the container.

5. The blow-molded container of claim 1 wherein the shoulder portion is isolated from the upper margin of the body portion by an inwardly extending hoop ring.

* * * * *

UNITED STATES PATENT AND TRADEMARK OFFICE

CERTIFICATE OF CORRECTION

PATENT NO. : 7,581,654 B2
APPLICATION NO. : 11/504268
DATED : September 1, 2009
INVENTOR(S) : Adam P. S. Stowitts It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 600 days.

Signed and Sealed this

Fourteenth Day of September, 2010

David J. Kappos

David J. Kappos
*Director of the United States Patent and Trademark Office*